US006428655B1

(12) United States Patent
Kerttula

(10) Patent No.: US 6,428,655 B1
(45) Date of Patent: Aug. 6, 2002

(54) INTEGRATED PAPER MACHINE

(75) Inventor: Reima Kerttula, Muurame (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/719,400

(22) PCT Filed: May 27, 1999

(86) PCT No.: PCT/FI99/00460

§ 371 (c)(1),
(2), (4) Date: Dec. 8, 2000

(87) PCT Pub. No.: WO99/64671

PCT Pub. Date: Dec. 16, 1999

(30) Foreign Application Priority Data

Jun. 10, 1998 (FI) ..... 981330

(51) Int. Cl.[7] ..... D21F 9/02

(52) U.S. Cl. ..... 162/289; 162/301; 162/308; 162/343; 162/358.3; 162/359.1; 162/361

(58) Field of Search ..... 162/109, 111, 162/201–208, 210, 289, 301, 308, 312, 314, 381, 358.1, 358.2, 358.3, 358.4, 358.5, 359.1, 360.2, 360.3, 361, 362, 336, 343; 34/108, 110, 111, 113, 116, 123

(56) References Cited

U.S. PATENT DOCUMENTS

| | | | | |
|---|---|---|---|---|
| 3,981,084 A | * | 9/1976 | Sobota | 34/123 |
| 4,324,613 A | | 4/1982 | Wahren | 162/111 |
| 4,361,466 A | | 11/1982 | Wong et la. | 162/207 |
| 4,376,014 A | | 3/1983 | Bergstrom | 162/336 |
| 4,483,745 A | | 11/1984 | Wicks et al. | 1652/205 |
| 4,526,655 A | | 7/1985 | Karvinen et al. | 162/360.1 |
| 4,757,585 A | | 7/1988 | Niskanen | 29/116.2 |

(List continued on next page.)

FOREIGN PATENT DOCUMENTS

| | | |
|---|---|---|
| DE | 4117597 | 3/1992 |
| DE | 4328310 | 3/1995 |
| DE | 19648045 | 5/1998 |
| EP | 0332594 | 12/1993 |
| EP | 0296730 | 7/1996 |
| FI | 59439 | 8/1981 |
| FI | 80102 | 4/1990 |
| FI | 89284 | 9/1993 |
| FI | 967790 | 8/1996 |
| FI | 970387 | 6/1998 |
| FI | 980766 | 10/1999 |
| FI | 973725 | 9/2000 |
| GB | 2079914 | 1/1982 |
| WO | 9510659 | 4/1995 |
| WO | 9914427 | 3/1999 |
| WO | 9955966 | 11/1999 |

OTHER PUBLICATIONS

U.S. Serial No. 08/977,973—Multi–Layer Headbox for a Paper/Board Machine (pp. 1–25).

(List continued on next page.)

*Primary Examiner*—Peter Chin
*Assistant Examiner*—Eric Hug
(74) *Attorney, Agent, or Firm*—Steinberg & Raskin, P.C.

(57) ABSTRACT

The invention concerns an integrated paper machine, which comprises, in the running direction of the web, a multi-layer headbox (100), a gap former (200), in which there is at least one pre-press (303, 304), a press section (300), in whcih there is at least one extended-nip press (308, 309), a pre-dryer section (400), in which the web (W) is dried by means of a high-capacity dryer unit, a dryer section (500), in which there is at least one dryer group ($R_1$, $R_2$, $R_3$) which makes use of single-wire draw, as well as a surface treatment device (P) for the web. Further, the paper machine is provided with a closed web draw at least to the end of the dryer section (500).

26 Claims, 7 Drawing Sheets

U.S. PATENT DOCUMENTS

| | | | | | |
|---|---|---|---|---|---|
| 4,790,909 | A | | 12/1988 | Harwood | 162/301 |
| 4,879,001 | A | * | 11/1989 | Cronin | 162/206 |
| 4,932,139 | A | | 6/1990 | Lehtinen | 34/41 |
| 4,976,821 | A | | 12/1990 | Laapotti | 162/360.1 |
| 5,022,163 | A | | 6/1991 | Ilvespää et al. | 34/23 |
| 5,074,964 | A | | 12/1991 | Partanen | 162/203 |
| 5,084,137 | A | | 1/1992 | Ilmarinen et al. | 1620/272 |
| 5,160,583 | A | | 11/1992 | Eaton et al. | 162/301 |
| 5,201,999 | A | | 4/1993 | Field et al. | 162/301 |
| 5,300,196 | A | | 4/1994 | Kraft | 162/300 |
| 5,438,920 | A | | 8/1995 | Koivukunnas et al. | 100/38 |
| 5,522,959 | A | | 6/1996 | Ilmarinen | 162/205 |
| 5,551,171 | A | | 9/1996 | Dahl | 34/625 |
| 5,593,545 | A | | 1/1997 | Rugowski | 162/207 |
| 5,685,813 | A | | 11/1997 | Kivioja et al. | 492/7 |
| 5,792,320 | A | | 8/1998 | Kaasalainen et al. | 162/205 |
| 5,865,955 | A | | 2/1999 | Ilvespääet et al. | 162/207 |
| 5,894,679 | A | | 4/1999 | Kuhasalo et al. | 34/117 |
| 5,897,745 | A | * | 4/1999 | Ampulski et al. | 162/109 |
| 6,001,421 | A | | 12/1999 | Ahonen et al. | 427/316 |
| 6,003,241 | A | | 12/1999 | Komulainen et al. | 34/117 |
| 6,004,429 | A | | 12/1999 | Schiel | 162/111 |
| 6,024,836 | A | * | 2/2000 | Sollinger et al. | 162/206 |
| 6,096,169 | A | * | 8/2000 | Hermans et al. | 162/115 |
| 6,128,833 | A | | 10/2000 | Juppi et al. | 34/464 |
| 6,129,453 | A | | 10/2000 | Holopainen et al. | 384/116 |
| 6,138,380 | A | | 10/2000 | Veijola et al. | 34/446 |
| 6,149,767 | A | * | 11/2000 | Hermans et al. | 162/109 |

OTHER PUBLICATIONS

U.S. Serial No. 08/323,839—Stock Feed System for a Multi–Layer Headbox and Method in the Operation of a Multi–Layer Headbox (pp. 1–12).

U.S. Serial No. 07/795,043—Method and Device for Dewatering of a Paper Web by Pressing (pp. 1–34).

"Future Paper Production Line Concepts Regarding Energy and Environmental Aspects"; Talja, R. et al.; Baden–Baden, XXVI EUCEPA Conference, Jun. 25–26, 1997 (pp. 1–13).

"High Consistency Sheet orming, Part 1: Research and Development of Headboxes; Part 2: Pilot Plant Test; and Part 3: Sheet Quality and Engineering Data"; Tadayoshi Nomura et al.; Tappi Journal; Jan. 1989 (pp. 115–122, 171–176; 187–192).

"New Development in High Consistency Forming"; Sandgren B., SPCI Confernece; Jun. 4–7, 1996 (pp. 616–628).

"Benchmaraks in the Forming of Printing Grades"; Ahonen, P.; Conference Valmet Paper Machine Days; Jun. 13–14, 1996 (pp. 43–48).

"The Contro Flo Former"; Sorma, O.; TAPPI Engineering Conference; 1983 (pp. 1–9).

"An Assessment of the Quality Aspects of Condebelt Dried Board and Paper"; Unkila, K., et al.; Tampella Papertech Dy; The Helsinki Symposium on Alternate Methods of Pulp and Paper Drying; Jun. 4–7, 1991 (pp. 237; 277–278).

"Neue Trockenpartiekonzepte für Papiermaschinen" ("New Dryer Section Concepts for Paper Machines"); Yli–Kauppila, J, et al; Das Papier, Heft 10A, 1995 (pp. V115–V122).

* cited by examiner

INTEGRATED PAPER MACHINE

FIELD OF THE INVENTION

The present invention relates to a paper machine and in particular to an integrated paper machine having, in a machine running direction, a multi-layer head box, a gap former, a press section, a pre-dryer section, a dryer section and a closed web draw.

BACKGROUND OF THE INVENTION

During the last 25 years, the increase in the consumption of paper and board was about 3.2% per year, and it is estimated that the increase will be about 2.8% per year during the following 15 years. Even though the total production of paper and board has increased constantly, the number of machines that produce these products has become lower. This is accounted for by the fact that new machines are always more efficient than their predecessors. A typical newsprint machine of the 1960's produces about 100,000 tons of paper in a year, whereas a typical paper machine of the 1990's produces about 300,000 tons of paper in a year. Such an increase in productivity has been based on constant product development in all of the constituent fields of papermaking.

The maximum width of a paper machine is these days about 10 meters, and it is not estimated that this width will be increased until the problems related to the massive constructions, such as high inertia, limitations related to production methods, and high costs have been solved. This will require considerable development in the fields of material sciences and production processes.

On the contrary, the running speed of the paper machine will still be increased. The speed has become three-fold in the course of the last 30 years, and no signs are seen regarding a slowing down of the increase in speed. The speed of current paper machines is about 1800 meters per minute, and speed records are made almost on a daily basis. The productivity will be increased by increasing the running speed of the machine in spite of the fact that the problems related to papermaking are increased almost exponentially along with an increase in the speed.

In the lecture "Future Paper Production Line Concepts Regarding Energy and Environmental Aspects" by Talja R., et al, Jun. 23 . . . 26, 1997, Baden-Baden, XXVI EUCEPA Conference, future perspectives of the development of paper machines are presented. In said paper, the applicant's vision about a paper machine of a near future is presented, whose running speed is 2000 meters per minute. The paper machine comprises a multi-layer dilution headbox, a SpeedFormer gap former, a SymBelt shoe press, in which there is a closed transfer-belt transfer to the dryer section, a JetSym Run II dryer section, in which there are high-capacity drying units and conventional cylinder dryers, an on-line OptiLoad soft calender, and an OptiReel centre-drive reel-up.

OBJECT AND SUMMARY OF THE INVENTION

The object of the present invention is to construct a paper machine by whose means it is possible to run at a speed higher than 2000 meters per minute and which is shorter than the present-day paper machines, whose overall length is about 130 meters. Further, as a raw-material in the paper machine, it must also be possible to use recycled fibre or some other fibre raw-material whose paper-technical properties are inferior.

By means of a paper machine in accordance with the present invention, it is possible to produce paper of good quality at a speed that is higher than 2000 meters per minute. The length of a paper machine in accordance with the present invention is shorter than the length of present-day paper machines.

The invention involves a number of features by whose means the speed capacity of the paper machine is affected. First, by means of a multi-layer headbox, within the scope of the quality-technical limits of the paper, it is possible to optimize the formation of stock components as layers so that a maximal water draining capacity is obtained in the former. A gap former provides a superb quality and runnability at high running speeds. Its problem is limited water draining capacity in particular with higher basis weights. A pre-press raises the dry solids content before transfer of the web to the press. This makes a pick-up transfer ever more reliable in particular at high speeds. When a major part of the water is already removed in the pre-press, the runnability of the press section proper is also improved. Traditionally, paper machines have an open draw from the press to the dryer section. Since the dry solids content of the web at the time of transfer from the press to the dryer section is about 50% or lower, the web is of low strength and susceptible of web breaks. The biggest problem of traditional cylinder drying is runnability on the first cylinders. The situation is deteriorated further by a closed transfer to the dryer section, because the web has not been tensioned in a draw of open transfer. A pre-drying unit fitted in accordance with the present invention of ours eliminates said problem as the unit dries the web further before the web enters into cylinder drying. A calender integrated in the dryer section permits calendering of the web so that the web is constantly supported. Of course, this also improves the runnability as it eliminates the fluttering and wrinkling of the web, which are typical of open gaps. In particular, a closed calender promotes threading of the web at high speed. The same arguments also apply to a closed draw to the reel-up.

In the solutions known from the prior art, just partial improvements have been suggested for different parts of the machine, but it is only by combining the above factors in one and the same concept that it is possible to put the advantages provided by said factors to use to full extent.

By means of a paper machine in accordance with the invention, it is also possible to have a positive effect on the quality of the paper. A multi-layer headbox provides abundant possibilities for optimizing the paper quality either by means of formation of fibre layers or by means of formation of layers of admixtures/chemicals in particular in combination with a roll-shoe gap former. In this way it is possible to apply a positive effect in particular on the printing quality of paper. As compared with other formers, a gap former provides by far the best paper (formation, uniformity of basis weight, orientation profile, distributions of fibres, fillers and fines in the direction of thickness, etc.), for which reason the gap former has largely replaced other former types in high-speed machines. If necessary, an extended-nip press provides economies in the bulk and porosity of the web. When the web does not have to be drawn between the press and the dryer section, the properties of strength of the paper are improved. Good runnability in the dryer section eliminates possible wrinkles and provides a more uniform tension profile. With a calender integrated in the dryer section, a higher drying capacity is obtained as compared with a dryer section with no pre-calendering. By means of pre-calendering, it is also possible to improve the properties of strength, smoothness and gloss of the paper. Impingement drying makes it possible to utilize drying that prevents shrinkage more efficiently than in the prior art and, thus, to provide, for example, a web whose dimensional stability in the cross direction is uniform. Formation of waves is also reduced.

The length of a paper machine is made shorter by the following features in accordance with the present invention:

- pre-pressing removes an abundance of water right in the wire part, in which case, under favourable conditions, just one press nip is needed in the press section,
- in the press section, in one embodiment, impulse drying or hot pressing is utilized, each of which increases the dry solids content after the press, which reduces the required need of drying,
- in the beginning of the dryer section, there is an efficient pre-drying unit,
- in the press section, the relative proportions of cylinders and suction rolls have been optimized,
- in the dryer section, there is an impingement drying unit fitted below the floor level, whose drying capacity is multiple as compared with cylinder drying,
- calendering in the dryer section improves the contact between the web and the cylinders, in which case the drying efficiency of the cylinders placed after the calender is increased,
- in a paper machine in accordance with the invention, conventional long draws in connection with the calender are avoided.

It is an essential realization in the present invention that the overall result is not even nearly optimal if the improvements known from the prior art are carried into effect one by one. For example, the speed potential of the paper machine is not increased at all irrespective of how high the running speeds of the former and of the press are if the web does not run through the dryer section or through a finishing device. In a similar way, for example, by means of multiple-layer formation certain improvements are achieved in the properties of the paper, but it is the pre-calendering in the dryer section that provides maximal advantages.

The dry solids contents in a paper machine in accordance with the present invention are typically:

- after the headbox, 0.3 . . . 3%,
- before the press, 18 . . . 30%,
- after the press, 45 . . . 65%, depending on the technique that is employed,
- after the pre-dryer, 55 . . . 70%, and
- after the dryer section, 92 . . . 98%, depending on paper grade.

In the following, components suitable for a paper machine in accordance with the invention will be described with reference to solutions in themselves known and suggested in patent literature or in other publications.

With respect to the multi-layer headbox suitable for the paper machine in accordance with the present invention, reference is made to the solution described in the applicant's FI Patent Application 964704. What is concerned is a multi-layer headbox, which comprises stock inlet headers, a tube bank, intermediate chambers, a turbulence generator, and a slice cone. The multi-layer headbox further comprises means for supplying the dilution liquid to a distribution plate placed between the inlet header and the tube bank. In this headbox, the stocks pass separate from one another to the end of the slice cone, where they are finally combined when they are transferred to the web former. Thus, for this multi-layer headbox, the designation fibrelayer headbox can be used.

In a paper machine in accordance with the invention, it is also possible to use a multi-layer headbox described in the applicant's FI Patent 92,729. In this solution, into each inlet header in the multi-layer headbox, a stock concept is supplied which has been produced out of the same fresh stock by adding to the fresh stock the necessary chemicals and fillers. For this multi-layer headbox, thus, the designation chemical/filler layer headbox can be used.

The consistency of the stock that is fed from the slice opening of the headbox of a paper machine in accordance with the invention into the gap former can be 1 . . . 3%, whereas a normal consistency of the stock is about 0.3 . . . 1%. The technique that can be concerned in web formation out of a high-consistency stock has been described, for example, in the paper "High consistency sheet forming, Part 1: Research and development of headboxes, Part 2: Pilot plant test, and Part 3: Sheet quality and engineering data" by Tadayoshi Nomura et al, January 1989, Tappi Journal, pp. 115 . . . 122, 171 . . . 176, and 187 . . . 192. In this connection, reference is also made to the lecture "New Developments in High Consistency Forming" by Sandgren B., SPCI conference on Jun. 4 . . . 7, 1996.

The scope of the embodiments of the present invention also includes a solution in which just a part of the stocks in a multi-layer headbox are at a higher consistency, as is suggested, for example, in the U.S. Pat. No 4,376,014.

In a paper machine in accordance with the invention, it is possible to use a roll-gap former, a shoe-gap former, or a roll-shoe gap former. One advantageous gap former suitable for a paper machine in accordance with the invention is the roll-shoe gap former marketed by the applicant with the product name SpeedFormer, in whose respect reference is made, for example, to the lecture "Benchmarks in the Forming of Printing Grades" by Ahonen P., held at the conference Valmet Paper Machine Days on Jun. 13 . . . 14, 1996 (copy attached to the present patent application. The gap former may also be provided with water drain elements that can be loaded, of which one embodiment is described in the applicant's FI Patent 98,540.

With respect to formers that can be applied in a paper machine in accordance with the invention, reference is also made to the U.S. Pat. No. 4,790,909 (Beloit Corp.), in which a roll-shoe gap former is described, to the U.S. Pat. No. 5,201,999 (Beloit Corp.), in which a shoe-gap former is described, and to the U.S. Pat. No. DE 4,117,597 (J. M. Voith GmbH), in which a gap former is also described.

In the U.S. Pat. No. 5,160,583 (Beloit Corp.), an integrated headbox/gap-former solution is described, in which the stock is constantly in a closed space when it moves from the headbox into the gap between the wires. In the solution, there is no free discharge jet and no free stock surface, which might be unstable and be decomposed in a detrimental way at high speeds. In a paper machine in accordance with the present invention, an integrated headbox/gap-former solution of this type can also be employed.

A second solution of integration of headbox and former which can be used favourably in a paper machine in accordance with the present invention has been described in the lecture "The Contro Flo Former" by Sorma O., TAPPI Engineering Conference 1983.

The gap formers mentioned above have been placed vertically so that the path of the stock is substantially in a vertical plane. In a paper machine in accordance with the invention, it is also possible to use a horizontal gap former, in which case the path of running of the stock is substantially horizontal.

In a paper machine in accordance with the invention, pre-pressing is employed in the former. The pre-pressing takes place preferably by means of an extended-nip press, but a roll nip can also be used. The shoe roll of the pre-press can be placed inside any of the two wire loops, depending on the details of the construction of the former and of the press section.

With respect to pre-pressing taking place by means of an extended nip, reference is made to the applicant's FI Patent 96,789, in which a press section and a press stage accomplished in the former by means of an extended-nip press zone are described. In the extended-nip press zone, preferably a compression pressure of 0.5 . . . 3 MPa is employed, and the length of the extended-nip press zone is preferably in a range of 100 . . . 300 mm.

With respect to pre-pressing taking place by means of a roll nip, reference is made to the applicant's FI Patent 98,843, in which the pre-press fabrics consist of a wire and of a transfer belt that does not receive water, and to the applicant's U.S. Pat. No. 5,522,959, in which the fabrics of the pre-press placed in the end of the former consist of two wires or of a wire and a press felt.

In the U.S. Pat. No. 4,879,001 (Beloit Corp.), a gap former is described, in which there is a pre-press based on a roll nip and in which the press felt that runs through the pre-press runs further into the following shoe nip.

In a paper machine in accordance with the invention, a press section is used in which there is at least one extended-nip press.

With respect to the press section, reference is made to the applicant's FI Patent 96,789 and to the prior-art publications referred to in said patent. In the patent, a press section of a paper machine is described, which comprises at least two separate press nip zones. At least through the first press nip zone, two press fabrics run which receive water, and the web runs between said fabrics through said nip zone. The paper web to be pressed has a closed draw supported by a press fabric from the pick-up point to the dryer section without free, unsupported draws.

In the applicant's FI Patent 81,854, the idea is suggested that a transfer fabric that does not receive water is employed in the press. Also, in the U.S. Pat. No. 4,483, 745 (Beloit Corp.), a press section is described in which the web runs through the press section between a belt not receiving water and a press felt. The nip or nips in the press section can be extended nips or roll nips. In a paper machine of the invention, said transfer fabrics not receiving water can be used in a way in itself known.

With respect to the rolls employed in the press section in a paper machine in accordance with the invention, reference is made to the applicant's U.S. Pat. No. 5,084,137 and to the applicant's FI Patents 75,217 and 79,177. In these patent publications, various variable-crown or adjustable-crown roll solutions are described.

At the rolls in the press section, glide bearings can also be used. Solutions with glide bearings have been described in the applicant's FI Patent 97,565 and in the applicant's FI Patent Application 970624.

In a paper machine in accordance with the invention, it is also possible to use impulse drying in the press section.

With respect to impulse drying, reference is made to the applicant's FI Patent 89,284, in which a method of impulse drying and an impulse dryer are described.

Impulse drying has also been described in the U.S. Pat. No. 4,324,613 (Wahren), in the WO Patent 95/10659 (Beloit Corp.), and in the EP Patent 296730 (Pulp and Paper Research Institute of Canada et al).

In stead of impulse drying, in the press section, it is also possible to employ hot pressing. Hot pressing is in the other respects similar to impulse drying, but in hot pressing lower temperatures are used. In hot pressing, the surface temperature of the backup roll is in a range of about 60 . . . 170° C., and in impulse drying it is higher than 170° C.

In a paper machine in accordance with the invention, a pre-dryer section is used, which is placed between the press section and the dryer section proper. The pre-dryer section can consist of an impingement-drying and/or through-drying cylinder of very large diameter and provided with a perforated mantle. The pre-dryer section can also consist of a substantially planar dryer section in which impingement drying is used, or of a dryer section of the Condebelt type.

With respect to a planar pre-dryer section provided with impingement drying, reference is made to the applicant's FI Patent Application 954714. In said patent application, a pre-dryer section is described in which the web runs in a substantially horizontal plane between an upper and a lower drying wire and in which impingement drying is applied to the web through the upper wire by means of an upper impingement drying unit, and impingement drying is applied to the web through the lower wire by means of a lower impingement drying unit.

In the U.S. Pat. No. 4,361,466 (Beloit Corp.), a planar, slightly upwards curved, relatively long pre-dryer section is described. Here the web runs on a belt loop penetrable by air and supported from below by suction rolls. Above the web, there are impingement drying units, by whose means drying air is blown towards the web.

In Condebelt drying, the web and the drying felt that supports the web run between two metal bands which form loops. The metal band that is in contact with the web is heated in order to evaporate water from the web, and the metal band that is in contact with the drying felt is cooled in order to condense the water that is evaporated from the web into the drying felt.

With respect to Condebelt drying, reference is made to the applicant's FI Patents 59,439, 80,102, and 96,790 and to the lecture given in the seminar at The Helsinki Symposium on Alternate Methods of Pulp and Paper drying, "An Assessment of the Quality Aspects of Condebelt Dried Board and Paper" by Unkila K., et al, Tampella Papertech Oy.

The dryer section in a paper machine in accordance with the invention starts favourably with a normal cylinder drying group that makes use of single-wire draw, in which the drying cylinders are placed above and the reversing suction rolls below.

After the first cylinder drying group, in the dryer section, it is possible to use a drying unit described in the applicant's FI Patent 100,013, which consists of a large-diameter impingement-drying and/or through-drying cylinder, at each of whose sides contact drying cylinders have been fitted. In the dryer section, there can be one or several such drying units. In this connection, reference is also made to the paper "Neue Trockenpartiekonzeptef für Papiermaschinen" ('New dryer section concepts for paper machines') by Yli-Kauppila J., Ilvespää H., Das Papier, Heft 10A, 1995.

With respect to the location of a large-diameter impingement-drying and/or throughdrying cylinder, reference is also made to the applicant's FL Patent Application 971713, in which the large-diameter impingement-drying and/or through-drying cylinder has been fitted in the space below the floor level of the paper machine hall and is provided with a blow hood which can be opened and closed.

With respect to impingement drying units, reference is made to the applicant's FI Patent Application 951746, in which heated air is blown by means of an impingement drying unit installed above a drying cylinder through the drying wire against the web which runs on the face of the drying cylinder.

In impingement drying, hot air or superheated steam is employed. In the impingement drying hood, heating and blow means have been integrated, as is described in the applicant's FI Patent Application 980766.

The final end of the dryer section in a paper machine in accordance with the invention consists of drying groups that make use of single-wire draw and in which groups the drying cylinders are placed above and the reversing suction rolls below.

In the dryer section, regulation of the curl of the paper web is also carried out. This is carried out in a way in itself known by means of steam boxes and/or by means of impingement drying units fitted in connection with drying cylinders.

In a paper machine in accordance with the invention, it is also possible to use a surface treatment section, e.g. a surface sizing and pigmenting device marketed by the applicant with the product name SymSizer.

In a paper machine in accordance with the invention, in the surface sizing equipment, it is also possible to use belt support, with respect to which reference is made to the applicant's FI Patent Application 970387.

The curl of a paper web is controlled in the ways suggested, for example, in the applicant's FI Patent Application 964830 or in publications referred to in said patent application. In the dryer section, the regulation of the curl has been accomplished by means of steam boxes, but instead of and/or in addition to said boxes, it is possible to use impingement drying boxes fitted on the drying cylinders in the dryer section.

In a paper machine in accordance with the invention, pre-calendering or any other pre-finishing is carried out in the dryer section. With respect to pre-calendering, reference is made to the applicant's FI Patent Application 960925. Inside a drying group that makes use of normal single-wire draw or in connection with the last drying cylinder, a free space has been arranged, in which a calender roll has been fitted. Together with a drying cylinder or roll, the calender roll forms a calendering nip. The calender roll can also be an extended-nip roll.

The surface treatment mentioned above can also be carried out in the dryer section.

With respect to the reversing suction rolls used in the dryer section, reference can be made to the roll solution described in the applicant's FI Patent 83,680. What is concerned is a roll marketed by the applicant with the product name VacRoll, which roll is provided with a perforated mantle and in which roll there is no separate suction box, but the whole of the interior space in the roll mantle is kept under vacuum. Of course, conventional suction rolls can also operate as reversing rolls.

In a paper machine in accordance with the invention, it is also possible to use an OptiSoft soft calender marketed by the applicant or an OptiLoad supercalender marketed by the applicant, which calender is described in the applicant's FI Patent 96,334.

BRIEF DESCRIPTION OF THE DRAWINGS

The transfer of the paper web from the dryer section to the calender has been accomplished preferably as a closed draw. In this respect, reference is made to the applicant's FI Patent Application 973725, in which a closed draw from a drying cylinder of the dryer section to a supercalender is described.

In a paper machine in accordance with the invention, as the reel-up, it is possible to use an OptiReel reel-up marketed by the applicant, which reel-up is described in the applicant's FI Patent 96,334.

The transfer of the paper web to the reel-up is preferably also accomplished as a closed draw. In the DE Patent 43 28 310 (Voith), a closed draw of the web to the reel-up has been described earlier.

In the following, the invention will be described with reference to the figures in the accompanying drawing, the invention being, however, not supposed to be confined to the details of said illustrations alone.

Figure 1:
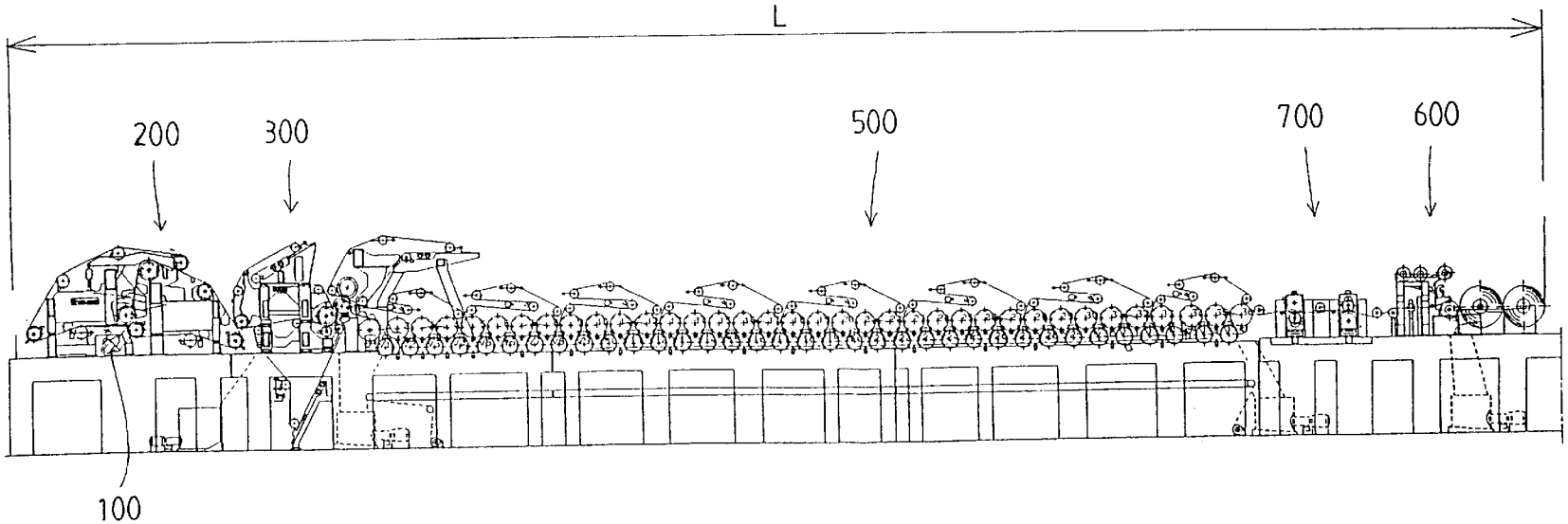
PRIOR ART FIG. 1

FIG. 1 illustrates a paper machine which represents the prior art.

Figure 2:
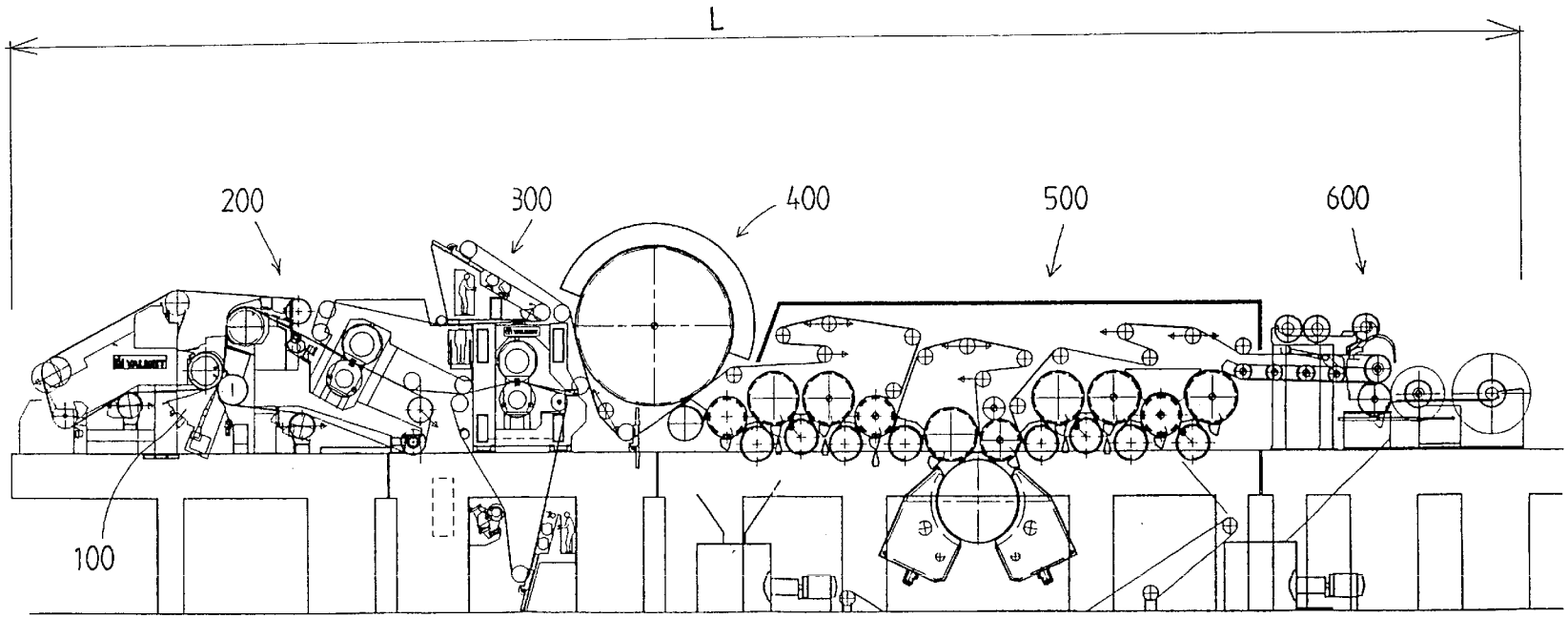

FIG. 2 illustrates a paper machine in accordance with the present invention.

Figure 3:
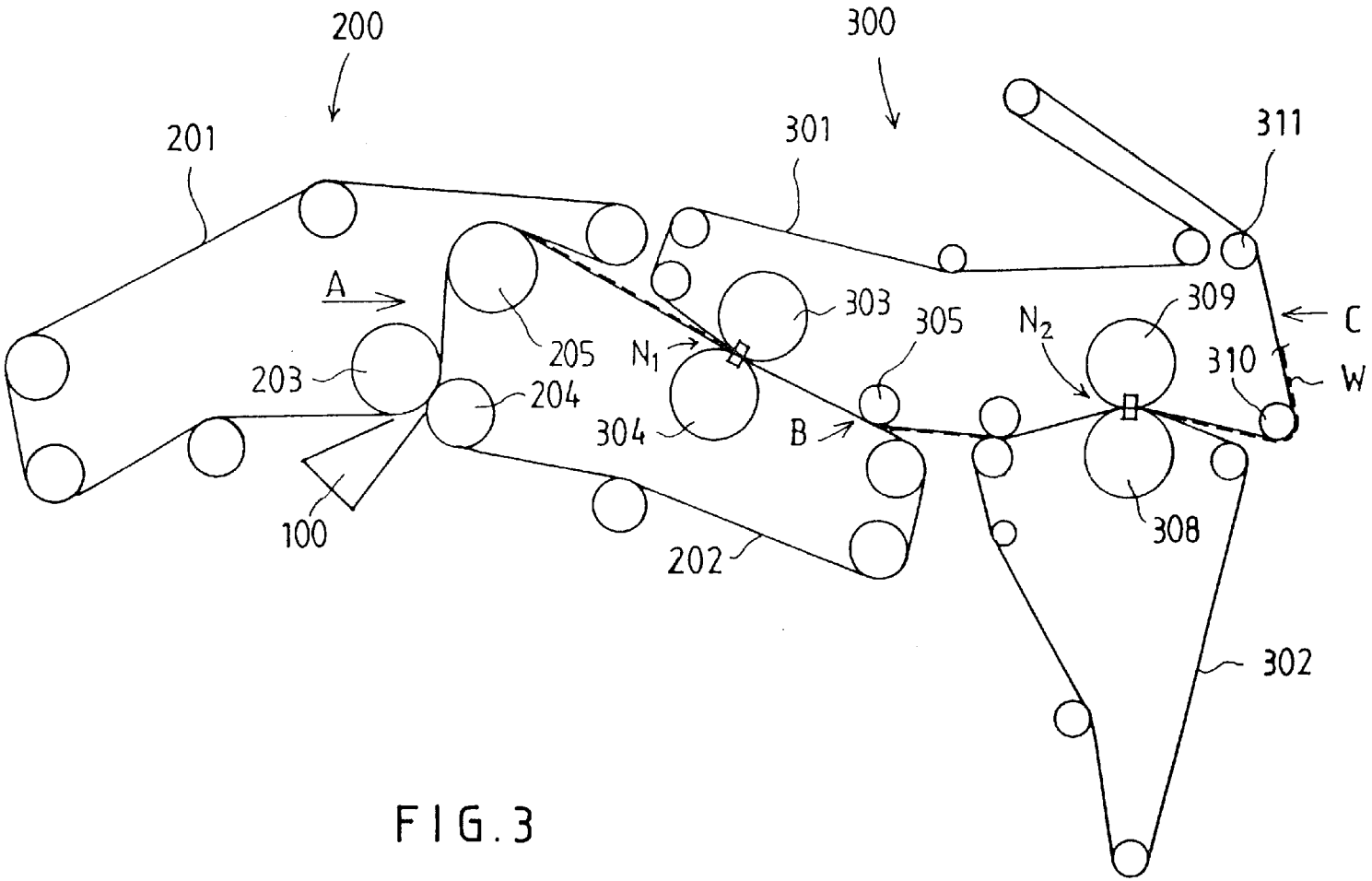

FIG. 3 is an enlarged view of the initial end of the paper machine shown in FIG. 2.

Figure 4:
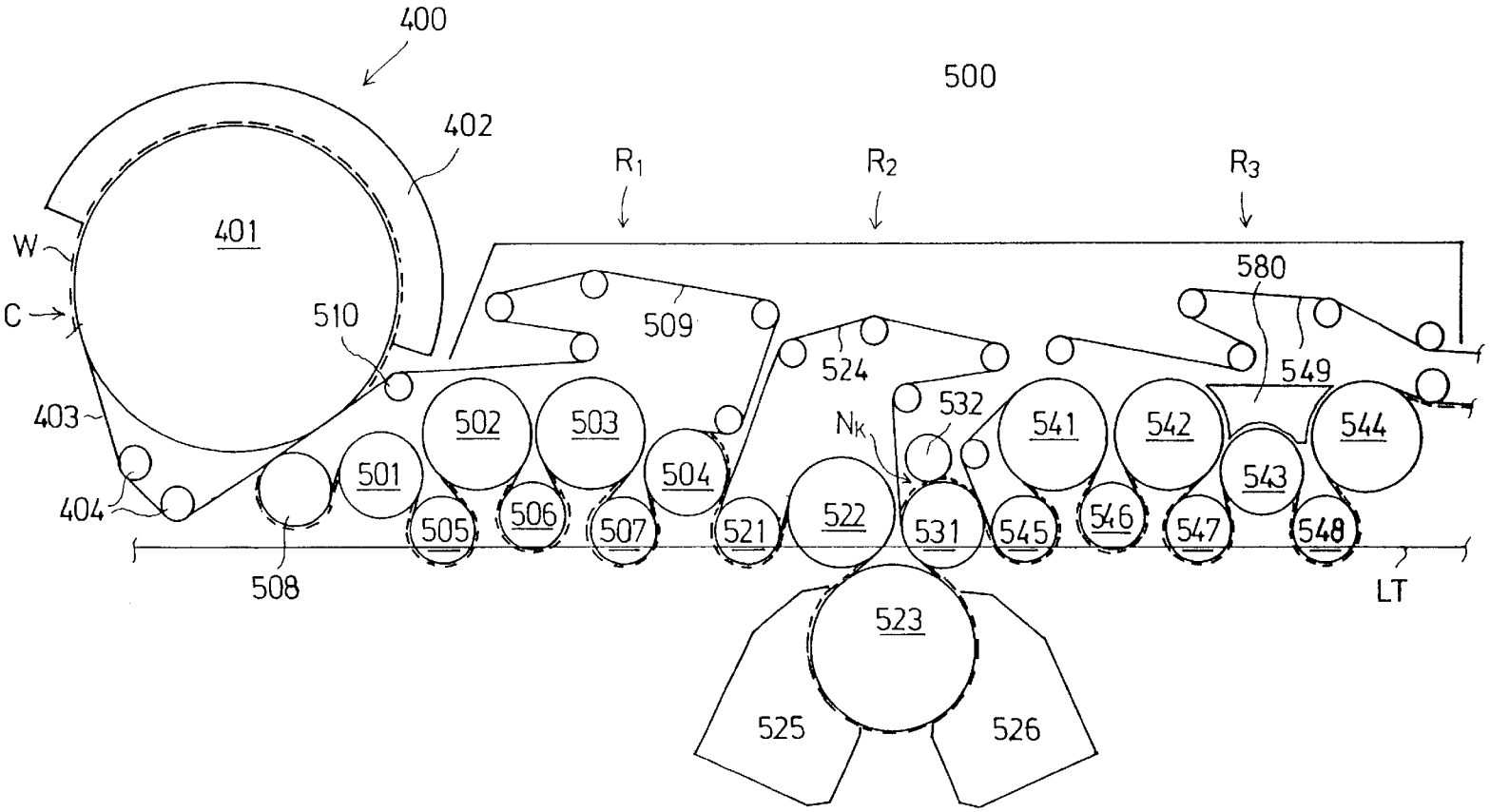

FIG. 4 is an enlarged view of the middle part of the paper machine of FIG. 2.

Figure 5:
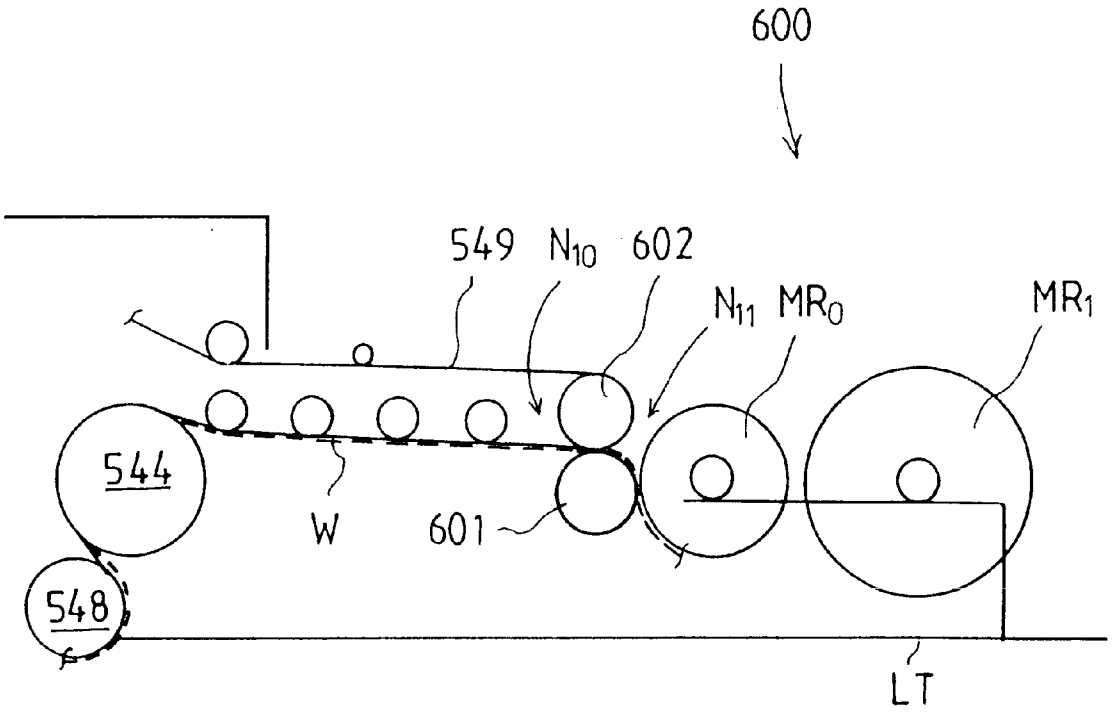

FIG. 5 is an enlarged view of the final end of the paper machine shown in FIG. 2.

Figure 6:
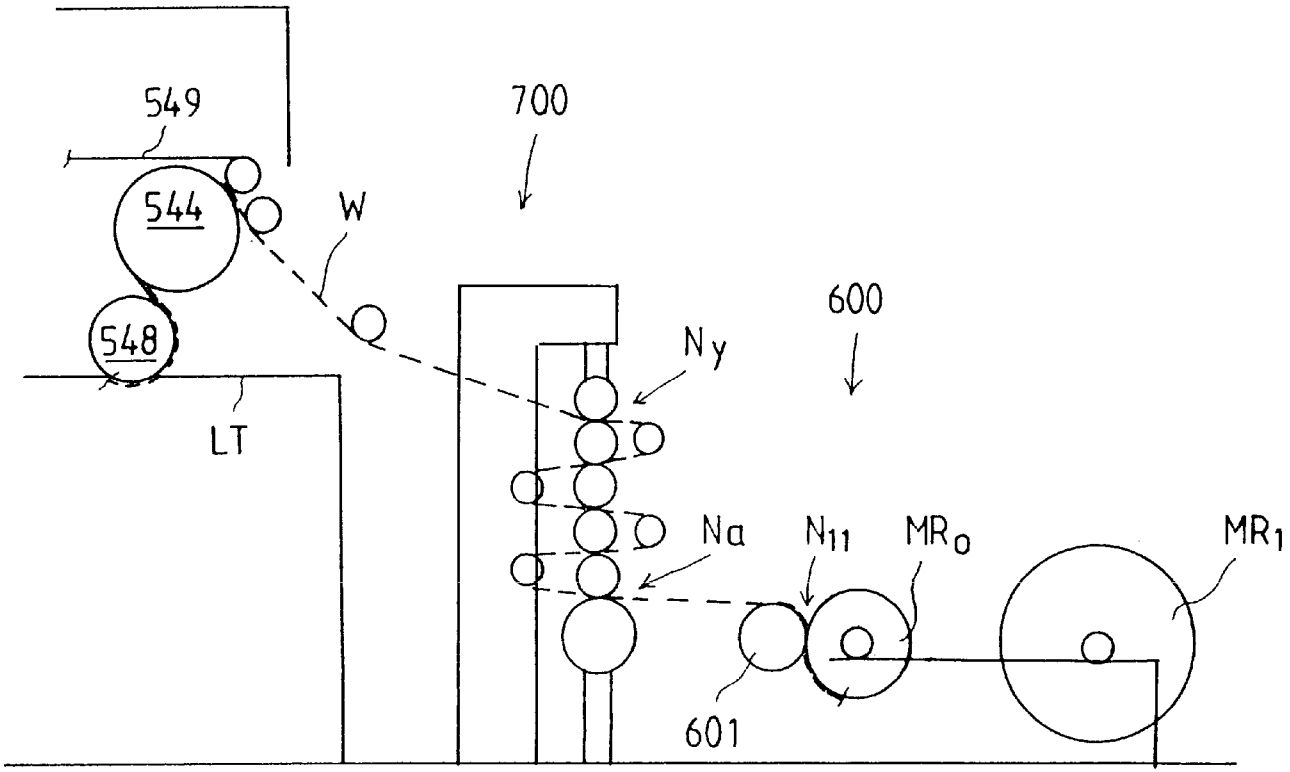

FIG. 6 is an enlarged view of a second final end of the paper machine shown in FIG. 2, which final end is provided with a supercalender.

Figure 7:
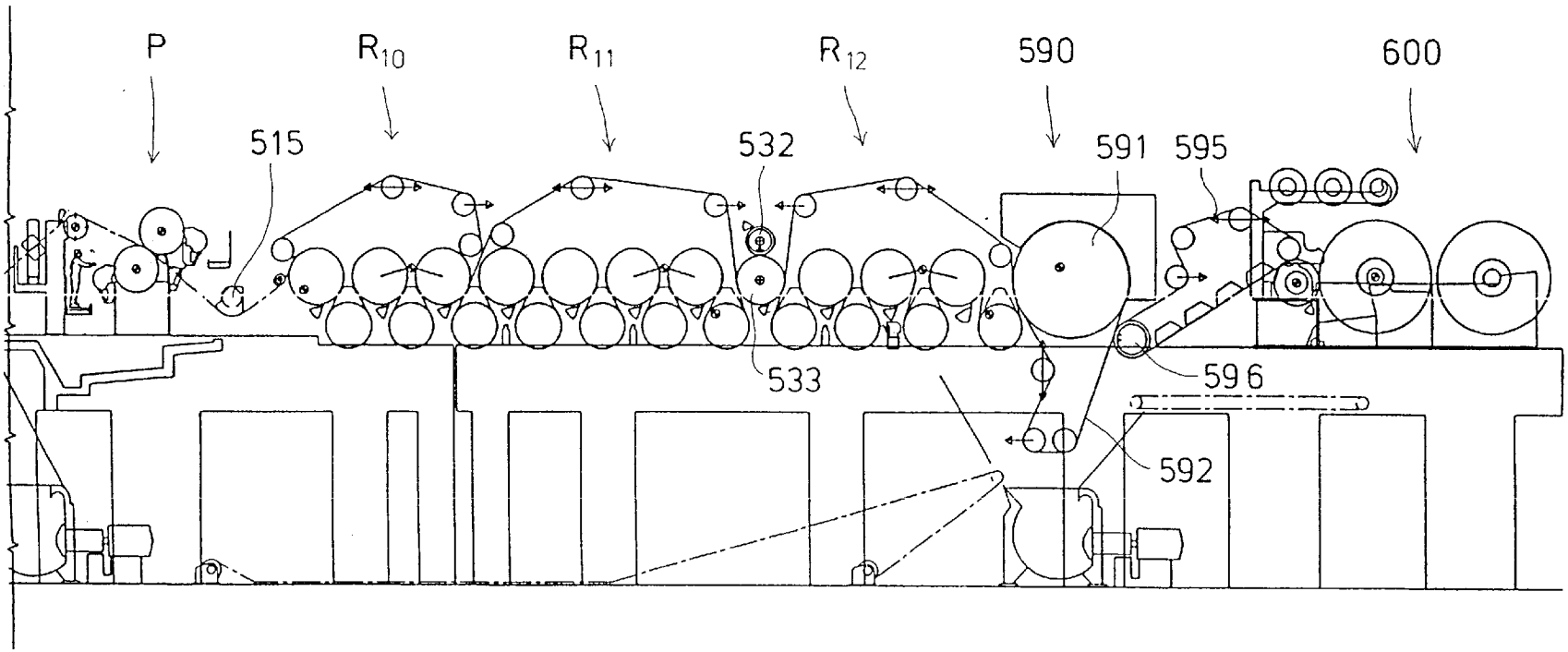

FIG. 7 illustrates the application of the principles of a paper machine in accordance with the present invention in an after-dryer section.

DETAILED DESCRIPTION OF THE INVENTION

FIG. 1 shows a paper machine which represents the prior art, in which machine there are a dilution headbox 100 marketed by the applicant with the trade mark SymFlo, a gap former 200 marketed by the applicant with the trade mark SpeedFormer, a press section 300 provided with an extended nip and marketed by the applicant with the trade mark SymPress, a dryer section 500, which is open towards the bottom, which makes use of single-wire draw, and which is marketed by the applicant with the trade mark SymRun, a two-nip soft calender 700 marketed by the applicant with the trade mark OptiSoft, and a reel-up 600 marketed by the applicant with the trade mark OptiReel. The design speed of such a prior-art newsprint machine is about 1800 meters per minute, and its overall length L is about 130 meters.

FIG. 2 shows a paper machine in accordance with the present invention, in which machine there are a multi-layer headbox 100, a gap former 200 provided with a prepress, a press section 300 provided with one extended-nip press, a pre-dryer unit 400, a dryer section 500, and a reel-up 600. The design speed of such a paper machine in accordance with the invention is about 2500 meters per minute, and its overall length L is just about 70 meters.

FIG. 3 shows the initial end of the paper machine shown in FIG. 2, comprising a headbox 100, a gap former 200, and a press section 300. In the gap former 200, there are a first wire loop 201 and a second wire loop 202, between which a substantially vertical forming zone A has been formed. From the headbox 100, the stock is fed into the gap formed by said wires 201,202 between the former roll 203 and the breast roll 204. After the forming zone A, the running direction of the web W that was formed is turned by means of a suction roll 205, by means of whose suction the web W is separated from the first wire 201 and made to adhere to the second wire 202, on whose face the web W is transferred into a pre-press nip $N_1$. The pre-press nip $N_1$ is a what is called extended nip, which is formed by a shoe roll 304 and by a backup roll 303. In the pre-press nip $N_1$ the web W runs between a first press felt 301 and the second wire 202. From the pre-press nip $N_1$ the web W runs between the second wire 202 and the first press felt 301 to the pick-up point B, at which the web W is separated from the second wire 202 by means of a pick-up suction roll 305 and transferred on support of the first press felt 301 into the press section.

In the press section the web W is passed between the first press felt 301 and a second press felt 302, where the web W runs into the first press nip $N_2$ proper. This press nip $N_2$ proper is also a what is called extended nip, which is formed by a shoe roll 308 and a backup roll 309. After the press nip $N_2$ proper, the web W is separated from the second press felt 302 and transferred on support of the first press felt 301 onto a reversing suction roll 310. On the reversing suction roll 310 the running direction of the press felt 301 and of the web W, which follows the press felt 301, is turned into a substantially vertical plane, On the portion between the reversing suction roll 310 and the guide roll 311 of the first press felt following after the reversing suction roll 310, at the point C, the web W is transferred onto a large-diameter impingement-drying and/or counterflow-drying cylinder in the pre-dryer.

FIG. 4 shows the middle portion of the paper machine, comprising a pre-dryer section 400 and a dryer section 500. The pre-dryer section 400 is composed of a suction cylinder 401 of very large diameter and provided with a perforated mantle, for which cylinder, in the following, the designation large cylinder will be used. A drying wire 403 runs around the large cylinder 401, which drying wire 403 has been separated from the face of the large cylinder 401 at the bottom portion of the large cylinder 401 by means of guide rolls 404. On the large cylinder 401, an impingement drying device 402 has been fitted, by whose means drying air can be blown against the web W. By means of such an impingement-drying and/or through-drying cylinder 401 of very large diameter, the length of drying of the web in relation to the progress of the web in the longitudinal machine direction of the paper machine is optimal.

The diameter of the large cylinder is, as a rule, chosen so that it is larger than 8 meters, preferably about 8 . . . 20 m. A sufficiently large diameter of the large cylinder and a sufficiently large wrapping sector of the drying wire and the web, about 200 . . . 300°, preferably about 220 . . . 280°, have the effect that the web has a sufficiently long distance and time of impingement-drying/through-drying on said large cylinder even at high speeds. A large diameter also increases the critical speed of the large cylinder and thereby has a favourable effect on the vibration properties of the large cylinder.

The web W is transferred from the press section onto the large cylinder 401 of the pre-dryer section 400 at the point C. At the point C, the first press felt 301 of the press section follows the face of the large cylinder 401 a certain distance, after which the suction of the large cylinder 401 separates the web W from the first press felt 301 and makes the web W adhere to the drying wire 403 which runs around the large cylinder 401.

The pre-dryer section 400 is followed by the dryer section 500 proper, in which there are three drying groups $R_1$,$R_2$,$R_3$ with single-wire draw only. The first group is a drying group $R_1$ open towards the bottom, in which the drying cylinders 501, 502,503,504 are placed above, and the reversing suction rolls 505,506,507,508 below. In relation to the floor level LT of the paper machine hall, the middle drying cylinders 502,503 are placed in the uppermost row and the outer drying cylinders 501,504 in a row placed at a slightly lower level. The outermost reversing suction rolls 505,507 are again placed in the row at the lowest level, and the middle reversing-suction roll 506 in a row placed at a slightly higher level. The diameter of the middle drying cylinders 502,503 is slightly larger than the diameter of the outer drying cylinders 501,504. By means of such an arrangement, the drying length of the web in relation to the progress of the web in the machine direction has been optinized.

On the first reversing suction cylinder 508 in the first drying group $R_1$, the web W is separated from the drying wire of the large cylinder 401 and affixed to the drying wire 509 of the first drying group $R_1$, after which the web W runs meandering between the reversing suction rolls 505,506,507 and the drying cylinders 501,502,503.

From the last drying cylinder 504 of the first drying group $R_1$ the web W is transferred in the nip between said drying cylinder 504 and the drying wire 524 of the second drying group $R_2$ onto the drying wire 524 of the second drying group $R_2$ and onto the first reversing suction roll 521 in the second drying group $R_2$. From the reversing suction roll 521 the web W is transferred onto the first drying cylinder 522 in the second drying group $R_2$ and from said cylinder further onto a large-diameter impingement-drying and/or through-drying cylinder 523 placed below the floor level LT of the paper machine hall. The impingement drying units of the impingement drying cylinder 523 are denoted with the reference numerals 525 and 526. From the impingement drying cylinder 523 the web W is transferred onto the drying cylinder 531 placed between the second drying group $R_2$ and the third drying group $R_3$. By means of the impingement-drying and/or through-drying cylinder 523 placed below the floor level LT of the paper machine hall, a long drying length is obtained for the web in relation to the progress of the web in the machine direction.

The web W is transferred onto the drying cylinder 531 placed between the second $R_2$ and the third drying group $R_3$ on the drying wire 524 of the second drying group $R_2$, which wire runs a certain distance on the face of said drying cylinder 531. After the drying wire 524 of the second drying group $R_2$ has departed from said drying cylinder 531, the web W is passed into the calendering nip $N_k$ between said drying cylinder 531 and the roll 532. Here the drying cylinder 531 and the roll 532 form a surface treatment device P. After the calendering nip $N_k$ the web W is transferred onto the drying wire 549 of the third drying group $R_3$, which runs a certain distance on the face of the drying cylinder 531 placed between the second $R_2$ and the third $R_3$ drying group.

The third drying group $R_3$ is similar to the first drying group $R_1$. From the last drying cylinder 544 in the third drying group $R_3$ the drying wire 549 of the third drying group $R_3$ transfers the web W to the reel-up, after which the wire returns onto the first reversing suction roll 545 in the third drying group $R_3$. Above the cylinder 543, an impingement drying hood 580 has been fitted, by whose means it is possible both to enhance the drying and to provide a double-sided drying favourable in view of the control of curl.

FIG. 5 shows the final part of a paper machine in accordance with the invention, which comprises a reel-up 600. The web W, being supported on the drying wire, is brought into the nip $N_{10}$ between the reel cylinder 601 and the alignment roll 602, at which nip the web W is separated from the drying wire 549 of the third drying group $R_3$ and affixed to the face of the reel cylinder 601 placed below in said nip $N_{10}$. This lower reel cylinder 601 also forms the reeling nip $N_{11}$ with the machine reel $MR_0$ to be formed. In the figure, a complete machine reel $MR_1$ is also illustrated, which reel is waiting to be transferred to storage.

FIG. 6 shows a situation in which the web W is transferred from the third drying group $R_3$ to an on-line supercalender 700. Here the web W is transferred as an open draw from the last drying cylinder 544 in the third drying group $R_3$ to the upper nip $N_y$ of the supercalender. After this the web runs over take-out leading rolls and through the nips in the supercalender and is transferred from the lower nip $N_a$ of the supercalender to the reel-up 600. In the reel-up the web W is transferred through the nip $N_{11}$between the reel cylinder 601 and the reel $MR_0$ to be formed onto the reel $MR_0$. Of course, also in connection with an on-line supercalender, the draw can be accomplished, for example, in the way described above as a closed draw.

FIG. 7 shows an after-dryer section in a paper machine in accordance with the invention. As is shown in the figure, the web enters into the surface-sizing/pigmenting unit P, for example to a device marketed by the applicant with the product name SymSizer, which surface-treats both faces of the web at the same time. After this the web is passed over a turning device 515 to the after-dryer section, which consists substantially of groups $R_{10}$, $R_{11}$, $R_{12}$ open towards the bottom and provided with single-wire draw. The transfer to the surface sizing unit and further to the after-dryer dryer section can also be supported in a way known from the prior art. In the afterdryer section, a calender 532,533 has been fitted. The calender roll 532 can form a calendering nip with a drying cylinder or, most appropriately, with the heatable second roll 533. In the end of the dryer section, an impingement drying unit 590 has been fitted, by whose means the drying capacity is increased and the curl of the web, which would otherwise arise from one-sided drying, is controlled. The impingement drying roll 591 is provided with a wire circulation 592 of its own. The transfer from the dryer section to the reel-up 600 is closed, while a wire 595 or equivalent supports the web. Of course, the transfer to the reel-up 600 can also be open, in view of, for example, fitting of devices that measure the properties of the paper through the web in this area. In such a case, it is preferable to place at least one drying or cooling cylinder after the suction roll 596 which picks up the web from the wire of the impingement drying unit 600, so that, in the transfer to the reel-up 600, it is possible to use prior-art solutions which have been found to be operable, for example solutions that are illustrated in FIG. 2 in the present patent application. The impingement drying unit 590 shown in the figure can also be used for control of the moisture profile or tension profile of the web.

In the following, the patent claims will be given, and the details of the invention may show variation within the scope of the inventive idea defined in said claims and differ from what has been stated above by way of example only.

I claim:

1. An integrated paper machine for the formation of a web (W) of surface treated paper or board, characterized in that, in a running direction of the web, the machine comprises:

a multi-layer head box (100), a gap former (200) having at least one pre-press (303, 304), a press section (300) having at least one extended-nip press (308,309), a pre-dryer section (400), in which the web (W) is dried by means of a high-capacity dryer unit, a dryer section (500) having a plurality of drying groups ($R_1$,$R_2$,$R_3$), said plurality of drying groups using a single-wire draw and wherein said plurality of cylinder drying groups are open towards the bottom of said paper machine, the dryer section (500) further having a surface treatment device (P) for the web, and wherein the paper machine is further provided with a closed web draw at least at an end of the dryer section (500) in the running direction of the web.

2. A paper machine as claimed in claim 1, wherein the multi-layer headbox (100) is a filler/chemical layer headbox.

3. A paper machine as claimed in claim 1, wherein the multi-layer headbox (100) is a fibre layer headbox.

4. A paper machine as claimed in any of the claim 1, wherein the gap former (200) comprises water drain elements that can be loaded.

5. A paper machine as claimed in claim 1, wherein the pre-press in the gap former (200) comprises at least one extended-nip press (303,304).

6. A paper machine as claimed in claim 1, wherein the press section (300) further comprises:

one of an impulse dryer and a hot-press device.

7. A paper machine as claimed in claim 1, wherein the press section (300) comprises at least one fabric and wherein said at least one fabric is a transfer belt which is impermeable to water.

8. A paper machine as claimed in claim 1, wherein the press section (300) further comprises two felts.

9. A paper machine as claimed in claim 1, wherein the press section (300) further comprises one felt.

10. A paper machine as claimed in claim 1, wherein the pre-dryer section (400) comprises:

a plurality of impingement drying devices fitted at least one of above and below the web (W).

11. A paper machine as claimed in claim 1, wherein the pre-dryer section (400) comprises:

a suction cylinder (401) having a larger diameter relative to other cylinders in the paper machine, and wherein said suction cylinder (401) is provided with a perforated mantle; and an impingement drying unit (402) operatively connected to said suction cylinder.

12. A paper machine as claimed in claim 1, wherein the pre-dryer section (400) comprises:

a Condebelt type dryer section.

13. A paper machine as claimed in claim 1, wherein the dryer section (500) comprises:

at least one large-diameter roll (523), and an impingement drying equipment (525,526) operatively fitted to said at least one larze-diameter roll (523).

14. A paper machine as claimed in claim 1, comprising:

a first drying group (R1) and a third drying group (R3), each of said first and third drying groups using a single-wire draw and wherein each of said first and third drying groups are open towards the bottom of said paper machine; and wherein the dryer section (500) comprises:

a second drying group (R2) structured and arranged between said first drying group and said third drying group, said second drying group using a single-wire draw and which second drying group includes a large-diameter drying cylinder (523) structured and arranged to be fitted below a floor level (LT) of a hall in which the paper machine is located, said large-diameter cylinder comprising an impingement drying equipment (525,526) operatively fitted to said large-diameter drying cylinder.

15. A paper machine as claimed in claim 1, wherein the dryer section comprises at least a front end and at least a final end; and a through-drying device (580) operatively connected to said at least final end of said dryer section, said through-drying device being structured and arranged to blow through a wire over which said web is transported, and wherein a curl of the web is regulated by said through-drying device.

16. A paper machine as claimed in claim 1, wherein the dryer section comprises a front end and a final end, and wherein in said final end there is provided an impingement drying unit (590), whereby a curl of the web is regulated by said impingement drying unit.

17. A paper machine as claimed in claim 1, wherein the surface treatment equipment (P) comprises:

a calendering equipment (531,532), in which a calendering of said web is carried out against a cylinder.

18. A paper machine as claimed in claim 1, wherein the surface treatment equipment (P) comprises:

a calendering equipment (531,532), in which a calendering of said web is carried out between a pair of rolls.

19. A paper machine as claimed in claim 1, wherein the surface treatment equipment (P) comprises:

a surface sizing device.

20. A paper machine as claimed in claim 1, wherein the headbox (100) and the wire part (200) form an integrated unit such that a slice jet has no free surface.

21. A paper machine as claimed in claim 1, further comprising:

an on-line supercalender (700).

22. A paper machine as claimed in claim 1, further comprising:

an on-line soft calender.

23. A paper machine as claimed in claim 1, further comprising:

a calendar and wherein said calender is a shoe calender.

24. A paper machine as claimed in claim 21, wherein a draw of the web from the dryer section (500) to the calender (700) is a closed draw.

25. A paper machine as claimed in claim 1, further comprising:

a reel-up (600).

26. A paper machine as claimed in claim 25, wherein a draw of the web from the dryer section (500) to the reel-up (600) is a closed draw.

* * * * *